United States Patent [19]

Chard et al.

[11] 4,160,890

[45] Jul. 10, 1979

[54] APPARATUS FOR INDICATING THE POSITION OF ROTATING MECHANICAL ELEMENTS

[75] Inventors: Gerald L. P. Chard, Taunusstein; Joachim Haupt, Wiesbaden; Werner Zuber, Hemsbach, all of Fed. Rep. of Germany

[73] Assignee: Motorola, Inc., Schaumburg, Ill.

[21] Appl. No.: 788,050

[22] Filed: Apr. 15, 1977

[30] Foreign Application Priority Data

Apr. 26, 1976 [DE] Fed. Rep. of Germany ..... 2618114

[51] Int. Cl.[2] ..... H01H 9/00

[52] U.S. Cl. ..... 200/308

[58] Field of Search ..... 200/308

[56] References Cited

U.S. PATENT DOCUMENTS

| | | | |
|---|---|---|---|
| 3,699,789 | 10/1972 | Potzick | 200/308 |
| 3,720,800 | 3/1973 | Arnold | 200/308 |
| 3,754,106 | 8/1973 | MacDonald | 200/308 |
| 3,879,692 | 4/1975 | Wisser et al. | 334/86 |
| 3,988,553 | 10/1976 | Astle | 200/308 |

FOREIGN PATENT DOCUMENTS

| | | | |
|---|---|---|---|
| 1318034 | 5/1973 | United Kingdom | 200/308 |
| 1441408 | 6/1976 | United Kingdom | 200/308 |

*Primary Examiner*—Robert I. Smith

*Attorney, Agent, or Firm*—James W. Gillman; Sang Ki Lee

[57] ABSTRACT

An apparatus for indicating the position of at least two rotatable mechanical elements in an indication field of a rotary switch, includes a pair of rotatable elements; an indication panel; a transparent dial skirt connected to each rotatable, each skirt having representative symbols arranged in an area along the outer periphery thereof for indicating the position of the rotatable elements and the areas of the skirt with the symbols overlapping in the indication panel.

6 Claims, 8 Drawing Figures

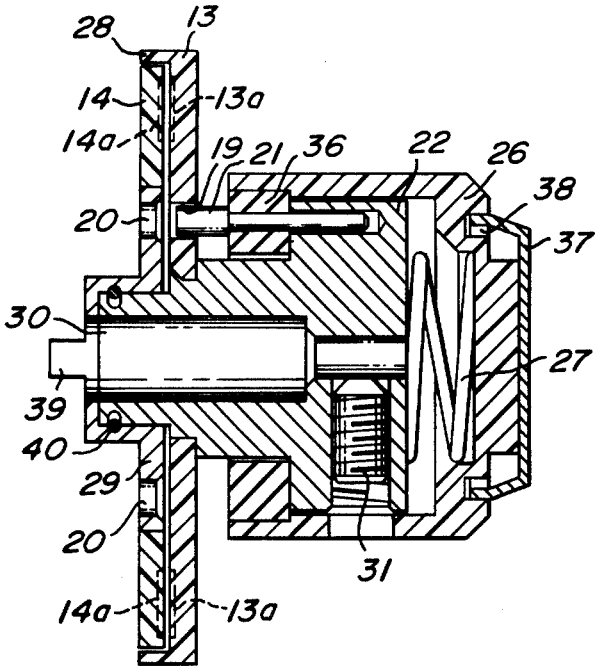
Fig. 1
Fig. 4
Fig. 2
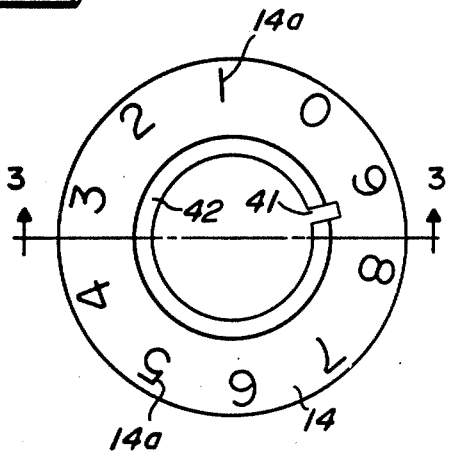
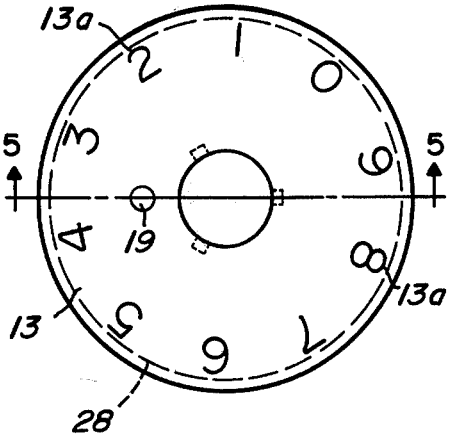
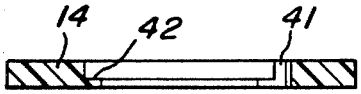
Fig. 3
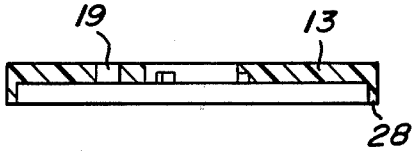
Fig. 5

APPARATUS FOR INDICATING THE POSITION OF ROTATING MECHANICAL ELEMENTS

FIELD OF THE INVENTION

This invention relates to an apparatus for indicating the position of at least two rotating mechanical elements in an indication field of rotary switches.

BACKGROUND OF THE INVENTION

In a multitude of devices it is necessary to house electromechanical components in as small a space as possible. These devices should be operable by hand and should include a rotating element which can be rotated to a desired position with settings that can be easily recognized by the user. Furthermore, the devices should be designed so that the device requires simple and reliable operation and should include as few, compact control elements as possible.

Up to now, known apparatus have not fully satisfied these requirements.

SUMMARY OF THE INVENTION

It is an object of the present invention to provide an improved apparatus for indicating the position of at least two rotating mechanical elements which provides simultaneously a particularly contrasting and easily readable indication in a limited area with easy operation.

According to an aspect of the present invention, the foregoing and other objects are attained by providing an essentially transparent disc rotatably connected to each of the rotating elements, wherein representative symbols are arranged in an area along the periphery of each dial skirt for positioning and indicating the position of the rotating elements and wherein the areas with the symbols of the dial skirts overlap in the indication field so that the symbols can be disposed adjacent to each other.

According to another aspect of the invention, several functions can be fulfilled independent of each other by one single control element so that the respective positioning is distinctly depicted simultaneously. It has also been shown to be very advantageous in the inventive arrangement that the components whose position is to be indicated, can be mounted side by side or behind each other in accordance with the requirements for the constructional details of the device. Thus, with the invention, a great multitude of variations in the arrangement of the components can be obtained by corresponding fashioning of the dial skirts which carry the information to be indicated.

According to a further aspect of the invention the apparatus is particularly suited for arranging two or more dial skirts, each containing the information symbols behind a face panel causing the respective information to be depicted to be visible in a window with the resulting important advantage that by means of illumination from behind or indirect lighting a dependable indication independent of the respective light relationships is satisfactorily guaranteed even under unfavorable conditions. The lighting can be easily adapted to the respective constructional factors since the position window must simply be sufficiently lighted to afford the illumination of a relatively small surface. So, a further advantage is thus obtained in that practically no interferring light or stray light is radiated from the inventive indicator device. This fact is of particular importance in case of application where the apparatus must be operated in a dark environment.

The inventive arrangement is also exceptionally flexible since the inscriptions on the dial skirts can be easily adapted to the respective use and can also be easily changed if needed. Furthermore, it is possible to interchange individual dial skirts if necessary without any particular expense.

Furthermore, several positioning procedures can be practically simultaneously carried out with only one hand.

The foregoing and other objects and aspects of the present invention will be more fully apprehended from the following detailed description of the illustrative embodiment of the apparatus in conjunction with the accompanying drawings.

BRIEF DESCRIPTION OF THE DRAWINGS

FIG. 1 is a cut-through view of the inventive arrangement.

FIG. 2 is a plan view of a dial skirt with symbols for the apparatus shown in FIG. 1.

FIG. 3 is a cut-through view of the dial skirt in FIG. 2 on section station 3-3.

FIG. 4 is a plan view of another dial skirt used together with the dial skirt shown in FIG. 2 and 3 in the arrangement according to FIG. 1.

FIG. 5 is a cut-through view of the dial skirt shown in FIG. 4 on section station 5-5 V-V.

DETAILED DESCRIPTION OF THE PREFERRED EMBODIMENT

Figure 8:
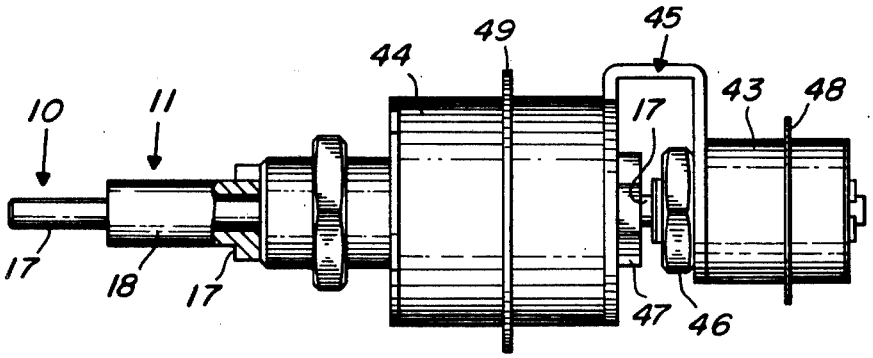
FIG. 8 shows two switch elements arranged behind each other for which the inventive apparatus can be advantageously employed.

In FIG. 1 a cut of the inventive apparatus is shown which can be used chiefly in one of the apparatus shown in FIG. 8. In FIG. 1 a bushing 22 has a central bore 30 with a relatively large diameter in its forward portion and a smaller diameter in its rear portion. The central boring 30 takes up a shaft 17 as shown in the apparatus according to FIG. 8. The shaft 17 is unrotatably connected to the bushing 22 by a setscrew 31. A transparent skirt 13 having indicator symbols 13*a* is arranged on the bushing 22. The construction of the dial skirt 13 is illustrated in more detail in FIGS. 4 and 5. At a smaller radial distance from the center the dial skirt 13 has an opening 19 through which a stud 21 is inserted which along with a bushing 36 is slideable in an axial direction on the bushing 22. The bushing 36 in which the stud 21 is inserted shows an essentially ring-shaped portion whose interior periphery is slideable on the outer periphery of a shaft of the bushing 22. The outer periphery of the bushing 36 is fixedly connected to an essentially cup shaped bushing element 26 and the bushing element 26 is slideable along with the bushing 36 in an axial direction on the bushing 22. In this case, the inner periphery of the cup shaped bushing element 26 slides on the outer periphery of the bushing 22. Between the end of the bushing 22 and the bottom of the cup-shaped bushing element 26 a helical compression spring 27 is arranged which maintains the bushing element in a retracted position. On the outside of the bottom, i.e., at its outer end, the bushing element 26 has a decorative cap 37. The decorative cap 37 is preferably glued in an annular tee-slot 38 in the bushing element.

While the front end of the stud 21 extends into the respective opening 19 of the dial skirt 13, the rear end of the stud 21 extends into a corresponding bore in the bushing 22 when the compression spring 27 maintains the bushing element 26 in a retracted position. Thus, the bushing element 26 is unrotatably connected with the bushing 22 by the rear end of the stud 21. Preferably the bushing element 26 has a milled edge on its exterior periphery to make the exterior periphery surfaces easier to grasp in view of easier turning.

The bushing 22 has a graded configuration in which on the section with the largest periphery shown in the right portion of FIG. 1 the bushing element is slideable, while according to the representation to the left in FIG. 1 a shaft with a smaller diameter is joined on which the bushing 36 with the stud 21 is slideable, while the dial skirt 13 is unrotatably arranged on a shorter section with a further reduced diameter. The portion of the bushing 22 opposite the dial skirt 13 extending farther to the left according to the representation in FIG. 1, and on this section a flange element 29 is pivoted which has claw-like meshing elements 39 on the portion shown on the left side of FIG. 1 which mesh in corresponding recesses in the hollow shaft 18 according to FIG. 8. On its radial equidistant flange section directly adjacent to the dial skirt 13 the flange element carries the essentially ringshaped dial skirt 14 which has respective indicator symbols. The flange element 29, compared with the bushing 22, is secured against an axial displacement by a spring ring 40. The dial skirt 14 has a somewhat smaller exterior diameter than the dial skirt 13, i.e., the dial skirt 13 protrudes in a radial direction over the dial skirt 14 and has a peripheral flange extending in an axial direction which overlaps the exterior periphery of the dial skirt 14 with little play. The indicator symbols **13*a* on the dial skirt 13 as well as 14*a* on the dial skirt 14 are respectively arranged on the side of the dial skirt 13, 14 respectively so that these indicator symbols are on the sides of the dial skirts facing each other. In this manner the indicator symbols 13*a*, 14*a*** respectively are displaced relative to each other in an axial direction at a very small distance so that practically no parallax error arises. Moreover, the indicator symbols are protected from damage or dirt by this arrangement.

As long as the bushing element 26 is maintained in its retracted position by the compression spring 27, the stud 21 meshes in the opening 19 of the dial skirt 13 so that the dial skirt 13 is also turned when the bushing element rotates, the dial skirt 14 which meshes with the hollow shaft 18 via its gearing element 39 remains stationary during the operation because the dial skirt 14 is freely rotatable on the bushing 22.

When the bushing element 26 is displaced to the left by the action of the compression spring 27 according to FIG. 1, the stud 21 is then introduced into one of the recesses 20 which are equidistantly arranged on a circular ring so that at corresponding predetermined stops one of the recesses 20 aligns with the stud 21. As soon as a stud 21 is thrust in the recess 20 both dial skirts 13 and 14 are unrotatably connected to each other. Thus the stud 21 acts together with the recess 20 as a coupling element so that the dial skirts 13 and 14 can be selectively decoupled when the compression spring 27 brings the bushing element into its retracted position so that the stud 21 is either retracted from the corresponding recess in the dial skirt 14 or by means of pressure on the decorative cap 37 both dial skirts and one of the recesses 20 are coupled via the stud 21.

Because the shaft 17 is unrotatably connected to the bushing 22 on the one hand and on the other hand the dial skirt 13 is always rotated with the bushing 22 the position of the dial skirt 13 shows via the corresponding indicator symbols the respective angular position of the hollow shaft 18 because the dial skirt 14 is unrotatably connected with the hollow shaft 18 via the flange element 29 and the meshing elements 39.

With the bushing element 26 either the shaft 17 can be selectively rotated opposite the hollow shaft 18 or both shafts 17 and 18 can be rotated together according to the above embodiments so that in this case the shaft 17 and the hollow shaft 18 represent the to be adjusted or rotatable mechanical elements 10 and 11.

In FIG. 2 a plan view of a preferred embodiment of the dial skirt 14 with its indicator symbols **14*a* is shown. It can be seen from FIG. 2 that the indicator symbols are the numbers 0 to 9 which are displaced somewhat to the left in comparison with the radius. As it can be seen from FIG. 4, which shows a plan view of the dial skirt 13 with its indicator symbols, the numbers 0 to 9 employed as indicator symbols in comparison with the radius are displaced somewhat to the right as differentiated from the arrangement according to FIG. 2. When both dial skirts 13 and 14 are concentrically arranged as shown in FIG. 1 a two digit decimal number results in that the 10's unit is an indicator symbol 14*a* and the 1's unit is an indicator symbol 13*a***.

By means of corresponding combinations of both dial skirts according to FIGS. 2 and 4 entire numbers can be represented in the arrangement according to FIG. 1.

According to FIG. 2 dial skirt 14 which is basically constructed as a round dial skirt has an indention 41 in which a corresponding projection of the flange element 29 extends to unrotatably connect dial skirt 14 with the flange element 29. The recess for the flange element 29 which is provided in the middle region of dial skirt 14 has an inwardly extending supporting flange as can be seen in FIGS. 2 and 3 which having a relatively lesser wall thickness and aligned with the one end of the dial skirt 14 forms a support for the flange element 29. The dial skirt 13 is shown in FIG. 4 and 5 in plan view and as a cut respectively. The indicator symbols **13*a* as well as the opening 19 and the peripheral flange 28 which overlaps the dial skirt 14 can be seen in these figures. The dial skirts 13 and 14** are preferably of a transparent material on which the indicator symbols are arranged to guarantee a constrasting (position) indication by means of lighting from the rear.

Clearly, instead of the indicator symbols shown in FIGS. 3 and 4 any other desired symbols can be used which are adapted to the respective purpose. For example, letters, colored areas or electrical circuit symbols can be used.

Figure 6:
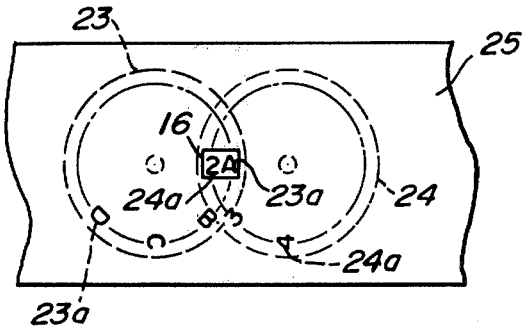
FIG. 6 is a schematic representation of another preferred embodiment of the inventive apparatus with two eccentric dial skirts.

FIG. 6 shows an alternative embodiment of the subject matter of the invention in a schematic representation. In this embodiment two eccentric dial skirts 23 and 24 which indicator symbols **23*a* and 24*a* respectively are shown. Both dial skirts 23 and 24 are respectively arranged behind a face panel having an indication field (16) constructed as a window. According to FIG. 6 the number "2" appears as the indicator symbols 24*a* of the dial skirt 24 in the indicator field and the letter "A" is the indicator symbol 23*a* of dial skirt 23**. Naturally any other desired indicator symbols can be used in this arrangement in which the dial skirts 23 and 24 respectively overlap in the circumference region. This embodiment of the subject matter of the invention is particularly suited for devices having several rotatable elements placed side by side. The arrangement according to FIG. 6 can basically be combined with the arrangement according to FIG. 1.

Figure 7:
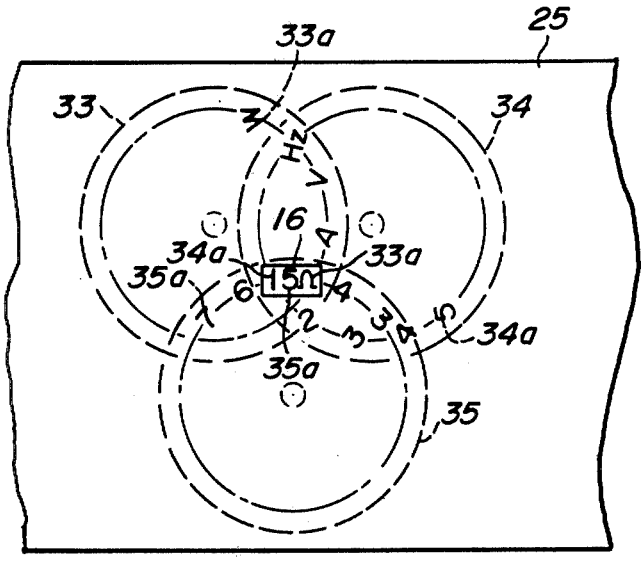
FIG. 7 is a representation similar to FIG. 6 but for an apparatus with three eccentric dial skirts.

FIG. 7 illustrates an arrangement where three dial skirts 33, 34 and 35 are eccentrically arranged so that the regions of their indicator symbols 33*a*, 34*a*, and 35*a*, respectively, overlap in an indication field. The indicator symbols are respectively arranged on the individual dial skirts in an angular position so that in the indication field a combination of three indicator symbols is given. In the embodiment shown in FIG. 7 the indicator symbols 33*a* have physical dimensions while the indicator symbols 34*a* and 35*a*, respectively are one unit decimal digits. Just as the arrangement according to FIG. 6 can basically be combined with an arrangement according to FIG. 1 in which further positions are shown in an additional or larger, respectively, indication field (not shown).

FIG. 8 illustrates in a schematic representation a combination of two rotary switches 43 and 44 which are connected by a bracket 45. The rotary switch 43 is screwed to the bracket 45 by means of a nut and has a positioning shaft 17 which is centrally passed through the rotary switch 44 which is also attached to a bracket 45 by means of a nut 47. The rotary switch 44 has a hollow shaft 18 through which the shaft 17 is passed according to the representation in FIG. 8 in the left portion of the figure and which extends out of the hollow shaft 18. The rotary switches 43 and 44 can both or individually be replaced by a lockable rotary potentiometer with defined settings. The individual taps of the potentiometer windings are schematically shown by 48 and 49 respectively. For example, soldering tabs could be provided to which corresponding connections are electrically joined. Of course, any other structural components or combination thereof can be provided instead of potentiometers. If the shaft 17 and the hollow shaft 18 respectively as shown in FIG. 1, are connected with a dial skirt 13, 14 respectively as an indicator element the respective angular position of the shaft 17 or the hollow shaft 18 is shown by the indicator symbols 13*a* or 14*a* respectively in a respective indication field. While FIG. 8 illustrates a preferred use for the device in FIG. 1, it should be clearly evident to the expert that the preferred embodiments illustrated in FIGS. 6 and 7 used in combination with the arrangement according to FIG. 1 offers a multitude of uses for the inventive device.

In the device according to FIG. 8 the shaft 17 and the hollow shaft 18 represent to be positioned or rotatable mechanical elements 10 or 11, respectively in the inventive device. However, any other rotatable mechanical elements 10 and 11 can be used according to the invention.

We claim:

1. A switching apparatus for positioning indicating dials, comprises:

a first rotatable shaft, a first dial skirt having a first array of indication symbols disposed thereon on a plane transverse to the axis of said first rotatable shaft, means for coupling said first dial skirt to said first rotatable shaft so that said first dial skirt can be rotated by said first rotatable shaft about the axis thereof, a second rotatable shaft co-axially disposed with said first rotatable shaft, a second dial skirt having a second array of indication symbols disposed thereon on a plane transverse to the axis of said first rotatable shaft, said second dial skirt fixedly mounted on said second rotatable shaft, a rotatable knob for rotating said first rotatable shaft to rotate said first dial skirt while said knob is held in a first position, and means for coupling said first rotatable shaft to said second rotatable shaft so that they can be rotated in synchronism about the axis of said first rotatable shaft by said knob while said knob is pressed in the axial direction into and held in a second position.

2. The apparatus as claimed in claim 1, wherein said first and said second dial skirts respectively have transparent planar surfaces and wherein the indication symbols are disposed at the periphery on the planar surfaces that are facing each other and wherein the second rotatable shaft is a hollow shaft through which the first rotatable shaft is disposed.

3. Apparatus as claimed in claim 2, wherein the indication symbols on said first and said second dial skirts disposed the planar surfaces are visible side by side.

4. Apparatus as claimed in claim 2, wherein the indication symbols on the two dial skirts are disposed to form two digit decimal numbers or alpha-numeric designations or electrical symbols or color-coded combination symbols.

5. Apparatus as claimed in 2, wherein said first dial skirt has a peripheral flange projecting in an axial direction to cover the gap between said first dial skirt and said second dial skirt to keep the two inner planar surfaces of the two dial skirts dust-free.

6. Apparatus as claimed in claim 5, wherein said coupling means includes.

first bushing element fixedly coupled to and surrounding said first and said second rotatable shafts, said bushing element having an off-axis bore in parallel with the axis of said first rotatable shaft, a second bushing element shaped in a form of a cup to cap substantially over said first bushing element, said second bushing element slidably mounted over said first bushing element for movement in axial direction, a third bushing element fixedly coupled to an end portion of the said second bushing element and slidable over said first bushing element, said first bushing element having a detent for setting a limit to the movement of said third bushing element, a spring interposed between an end of said first bushing element and inside of said second bushing element whereby said second bushing element is held off to a first position set by said first bushing element under the tension of said spring applied against said first and said second bushing elements, a stud disposed in the bore of said first bushing element and having a protruding pin, said first dial skirt having a hole disposed to receive the pin protruding from the first bushing element, a flange with a plurality of holes fixedly coupled to said second dial skirt, said plurality of holes aligned to receive the pin therethrough, whereby when said second bushing element is pressed against said spring, said second bushing element slides over said first bushing element and moves said pin into one of the holes in the flange thereby coupling said first dial to the second dial, said first shaft to said second shaft in fixed position relative to each oher to permit rotation of said first and second dial in synchronism when said second bushing element is rotated about the axis of second rotatable shaft while said second bushing element is pressed against said spring.

* * * * *